US008657018B2

(12) United States Patent
Cravatte

(10) Patent No.: US 8,657,018 B2
(45) Date of Patent: Feb. 25, 2014

(54) CIRCULATING SUB

(75) Inventor: Philippe Cravatte, Malmedy (BE)

(73) Assignee: Corpro Systems Limited, Aberdeenshire (GB)

( * ) Notice: Subject to any disclaimer, the term of this patent is extended or adjusted under 35 U.S.C. 154(b) by 377 days.

(21) Appl. No.: 12/962,844

(22) Filed: Dec. 8, 2010

(65) Prior Publication Data

US 2012/0043093 A1 Feb. 23, 2012

(30) Foreign Application Priority Data

Dec. 8, 2009 (GB) ..... 0921440.4

(51) Int. Cl.
*E21B 29/00* (2006.01)
*E21B 34/00* (2006.01)

(52) U.S. Cl.
USPC ..... 166/376; 166/318

(58) Field of Classification Search
USPC ..... 166/376, 318, 317, 193, 194
See application file for complete search history.

(56) References Cited

U.S. PATENT DOCUMENTS 4,176,717 A * 12/1979 Hix ..... 166/289
5,499,687 A * 3/1996 Lee ..... 175/317
7,416,029 B2 * 8/2008 Telfer et al. ..... 166/386
7,934,559 B2 * 5/2011 Posevina et al. ..... 166/318
8,356,671 B2 * 1/2013 Guillory et al. ..... 166/318
8,403,037 B2 * 3/2013 Agrawal et al. ..... 166/193
2008/0190620 A1 8/2008 Posevina et al.
2011/0278017 A1 * 11/2011 Themig et al. ..... 166/373

FOREIGN PATENT DOCUMENTS

WO WO 97/36088 10/1997
WO WO 2007/060449 A2 5/2007

* cited by examiner

*Primary Examiner* — Daniel P Stephenson
(74) *Attorney, Agent, or Firm* — Anthony P. Filomena; Taft, Stettinius & Hollister, LLP

(57) ABSTRACT

A circulating sub apparatus including a substantially tubular outer body member having a throughbore formed therein and a substantially tubular inner body member. The outer body member having at least one hole formed therein and a displacement mechanism for producing movement of the inner body member relative to the outer body member such that the inner body member is moveable between an open configuration and an obturated configuration. The inner body member includes a seat member adapted to catch a dropped object, the seat member is located upstream of the hole(s) of the outer body member in both the open and obturated configurations, and wherein the seat member is adapted to permit at least a proportion of fluid to flow past the dropped object when it is seated thereon.

13 Claims, 16 Drawing Sheets

CIRCULATING SUB

CROSS-REFERENCE TO RELATED APPLICATIONS

This application claims priority under 35 U.S.C. §119 from Great Britain Patent Application No. 0921440.4 filed on Dec. 8, 2009, the disclosure of which is incorporated by reference herein.

RELATED ART

1. Field of the Invention

The present disclosure relates to an apparatus and method relating to a circulating sub and also to a drop ball, and more particularly to a multi-activation circulating sub for use in energy exploration and drilling that can be opened and closed with dropped objects and more particularly can be repeatedly operated without having to use objects that increase in size.

2. Brief Discussion of Related Art

Circulating subs are used to redirect circulation of downhole fluid to transport debris or cuttings produced from the cutting action and also to allow pumping of Lost Circulation Material (LCM). Generally, circulating subs can be operated in an open and in a closed position. Often, a conventional circulating sub can only be moved once from one to the other position. Other conventional circulating subs can be opened by dropping a first object such as a drop ball which can leave the circulating sub when the seat enlarges, for example when it is moved into a recess. Depending on the design of the circulating sub, it can only be operated again either when a second drop ball larger than the first is dropped into the circulating sub to land on the enlarged seat, or can only be operated a particular number of times because the drop balls will fill up a drop ball catching chamber.

INTRODUCTION TO THE INVENTION

According to a first aspect of the present disclosure, there is provided a circulating sub apparatus comprising:

a substantially tubular outer body member having a throughbore formed therein;

a substantially tubular inner body member;

wherein at least the outer body member further comprises one or more holes formed therein; and a displacement mechanism for producing movement of the inner body member relative to the outer body member such that the inner body member may be moved between:

an open configuration, in which the one or more holes on the outer body member are open such that fluid may pass between the throughbore and the outside of the circulating sub apparatus via the one or more holes; and an obturated configuration, in which the one or more holes on the outer body member are obturated;

wherein the inner body member comprises a seat member adapted to catch a dropped object characterized in that the seat member is adapted to permit at least a proportion of fluid to flow past the dropped object when it is seated thereon.

In exemplary form, the seat member is located upstream of the one or more holes of the outer body member in both the open and closed configurations.

According to an alternative first aspect of the present disclosure, there is provided a circulating sub apparatus comprising:

a substantially tubular outer body member having a throughbore formed therein;

a substantially tubular inner body member;

wherein at least the outer body member further comprises one or more holes formed therein; and a displacement mechanism for producing movement of the inner body member relative to the outer body member such that the inner body member may be moved between:

an open configuration, in which the one or more holes on the outer body member are open such that fluid may pass between the throughbore and the outside of the circulating sub apparatus via the one or more holes; and an obturated configuration, in which the one or more holes on the outer body member are obturated;

wherein the inner body member comprises a seat member adapted to catch a dropped object characterized in that the seat member is located upstream of the one or more holes of the outer body member.

In exemplary form, the seat member of the alternative first aspect is adapted to permit at least a proportion of fluid to flow past the dropped object when it is seated thereon.

Typically, when in the obturated configuration, the one or more holes on the outer body member are obturated by the inner body member.

In exemplary form, the object is a ball and the seat member is adapted to catch a ball which is dropped down the throughbore of the circulating sub apparatus from the surface of a borehole into which the circulation sub is run on a string of tubulars.

Typically, the dropped object substantially blocks the throughbore of the circulating sub when it lands on the seat member but, in exemplary form, the seat member comprises slots, apertures or other suitable forms of bypass channels which remain open or unblocked when the object is landed on the seat member and the slots or the like permit a certain proportion of fluid to flow past the dropped object when it is seated on the seat member.

When the object blocks the inner passage of the circulating sub the downhole fluid pressure and/or the force caused by the fluid flow acting on the inner body member is increased and displaces it in a downward or downstream direction. In both the open and the obturated configuration, downhole fluid flows past the seat member and thus past an object when seated in the seat member.

The displacement mechanism is controlled by downhole fluid flow and/or pressure that acts on at least a portion of the displacement mechanism and/or the inner body member.

In the open configuration of the circulating sub, downhole fluid can flow from the surface of the borehole, through an inner passage such as a throughbore of a tubular string, wherein the inner passage is typically substantially parallel to the longitudinal axis of the circulating sub and typically from the throughbore of the circulating sub and from the throughbore of the inner body member wherein at least a portion of the fluid will flow through the one or more holes in the outer body member to the borehole annulus located outside of the circulating sub.

In the obturated or closed configuration of the circulating sub, downhole fluid typically can flow from the surface of the borehole, through an inner passage such as a throughbore of a tubular string, wherein the inner passage is typically substantially parallel to the longitudinal axis of the circulating sub and typically from the throughbore of the circulating sub and from the throughbore of the inner body member and flow out of a bottom end of the circulating sub, for example to the throughbore of equipment located in the tubular string below the circulating sub.

The circulation sub apparatus is, in exemplary form, used with an object that is adapted to erode or dissolve over time when it is landed on the seat member. The object and, in exemplary form, the ball is typically eroded over a certain time period by the action of the downhole fluid that is passing the ball while flowing through the slots of the seat member. The ball in exemplary form consists of a material that will not be eroded to an extent which would make it impossible to complete the opening operation of the circulating sub until the operation is completed.

The inner body member and/or the displacement mechanism in exemplary form comprise a piston.

Typically, the inner body member further comprises one or more holes therein.

Typically, the one or more holes of the inner and/or outer body member are substantially transverse to the longitudinal axis of the inner and/or outer body member.

Typically, movement of the inner body member into the open configuration moves the one or more holes of the inner body member into fluid communication with the one or more holes of the outer body member.

In exemplary form, the displacement mechanism is adapted to permit the inner body member to be repeatedly moved between the open position and the obturated position.

In exemplary form, the seat member is provided on or towards the upper end of the inner body member and typically, the seat member is located above the one or more holes of the inner body member as well as above the one or more holes of the outer body member.

The inner body member in exemplary form comprises a lower portion and an upper portion. Typically, the upper portion comprises the seat member and the one or more holes. The upper portion can further comprise a blocking portion which is provided such that it obturates the holes of the outer body member from inside the outer body member when the circulating sub is in the closed configuration. The lower portion typically engages at least a portion of the displacement mechanism when the inner body member is moved due to the force fluid flow and/or pressure.

Typically, the displacement mechanism further comprises a locking mechanism for locking the inner body member in at least two (or three) positions relative to the outer body member.

In exemplary form, the displacement mechanism further comprises a cam member comprising one of a lock device and which may comprise a key device and a guide mechanism which may comprise a slot arrangement for engagement with the lock device.

The displacement mechanism can further comprise a biasing mechanism which can, in exemplary form, comprise a spring member for biasing the inner body member towards or into one of the open and closed configuration. The biasing mechanism is in exemplary form arranged such that it resists and/or stores energy when the inner body member is moved downwards or downstream and/or is positioned in the open configuration due to pressure or force exerted on the inner body member by fluid flow and/or pressure. Typically, the biasing mechanism is adapted to release the stored energy and thereby expand when the said force is released.

In exemplary form, the displacement mechanism further comprises a biasing mechanism retaining member which may comprise a substantially tubular hollow member positioned below the inner body member to engage the inner body member and the spring member and the substantially tubular hollow member comprises a shoulder to separate and thereby prevent the spring member from engaging the cam member.

The cam member in exemplary form provides at least three locking positions for locking the inner body member in at least three positions relative to the outer body member by means of the locking member. The locking positions can be provided such that the ports of the inner and outer body member are in fluid communication and more in exemplary form are in a substantially aligned relationship in at least two of the at least three locking positions and in an obturated configuration such that the fluid is not able to communicate between the holes of the inner and outer body members in the at least one other locking position. In one of the said two fluid communication locking positions, the circulating sub can be in a fully open port configuration. This provides the advantage that downhole fluid can flow through the circulating sub and the said holes without a dropped object partially blocking the seat. The fully open configuration is in exemplary form provided when the object dropped into the circulating sub is no longer caught in the seat member and has been eroded and flushed out of the lower end of the circulating sub.

The locking positions are more in exemplary form provided such that when the locking member is positioned in a first locking position, in which the holes are in an obturated position, and the cam member is rotated, the following two locking positions provide the open hole configuration of the holes of the inner and outer body member.

Typically, the holes of the inner body member are elongated along the longitudinal axis of the inner body member such that an aligned position of the holes of the inner and outer body member can be established over a certain section or length of the inner body member. The length of the said certain section may be in the region of a length equivalent to the longitudinal length of the elongated holes of the inner body member.

Typically, the holes of the outer body member are provided as nozzles or ports formed through a side wall thereof.

In exemplary form, the inner body member comprises one or more grooves for a retaining seal on an outer surface thereof transverse to its longitudinal axis. Typically, the one or more grooves can be provided on an outer surface of the seat member and/or on an outer surface of the blocking portion. The grooves and the seal are adapted to prevent downhole fluid from flowing past the outer surface of each of the seat member, the blocking portion and/or the lower portion of the inner body member.

According to a second aspect of the disclosure, there is an object for dropping into a fluid flow pumped down a borehole in a downhole well, the object comprising one or more chambers therein.

In exemplary form, the object is a ball and more in exemplary form the object is hollow. The chamber may be a void comprising a vacuum but may in exemplary form comprise a chamber that is filled with a material that differs in physical properties such as burst or collapse strength compared to the rest of the object. Typically, the chamber may be filled with a gas at a pre-determined pressure and in further exemplary embodiments may be filled with air at atmospheric pressure. In exemplary form, the chamber is sealed from the environment outside of the ball and is in exemplary form sealed by the rest of the material that forms the sidewall or body of the ball.

In exemplary form the ball is formed from a material around the chamber that is erodible in the fluid flow and more particularly is adapted to be eroded to a certain extent and then collapse or implode due to the pressure of the external fluid being far higher than the internal pressure of the ball.

In exemplary form, the ball is particularly for use with the circulating sub according to the first aspect of the disclosure such that the erodible hollow ball is adapted to be landed on the seat member of the circulating sub. The exemplary features of the second aspect of the disclosure can be incorporated into the first aspect of the disclosure as appropriate.

Embodiments in accordance with the first aspect of the disclosure have the advantage that they can effectively be used with embodiments of an erodible ball in accordance with the second aspect of the present disclosure. A fully open configuration of the circulating sub, which is the configuration in which downhole fluid can flow through the circulating sub and the holes or ports without a ball in the seat, can be established in a rather short period of time. From this open port configuration, the circulating sub can easily be returned to a closed port configuration by dropping another erodible ball, which is similar to the first one, into the downhole string. The circulating sub will then be closed in about the same time that was needed to establish the fully open configuration because the ball is exposed to the same conditions as the first ball, i.e. a pressure affecting the ball and/or the amount of fluid flowing past the ball inside the circulating sub creating friction on the ball which erodes or for certain materials of ball will dissolve the ball. This advantage results from a number of aspects including the seat member being located upstream of the ports in both the open and the closed configuration of the circulating sub. Furthermore, when the ball is hollow, it does not need to be eroded completely but rather to an extent in which the outside pressure is sufficient to crush the ball due to the differential pressure inside the ball. Furthermore, erodible balls may be used instead of dissolvable balls because the erodible ball will not experience much erosion on the path from the surface of the borehole to the seat because there is much less friction acting on the ball during that time because the ball is being carried along by the fluid through the string as opposed to being eroded away when it is caught by the seat member due to the friction acting on it from the relatively high velocity downhole fluid travelling past the ball. To the contrary, a dissolvable ball may suffer from the disadvantage that it could dissolve before it reaches the seat because it will dissolve in static fluid as well as fluid moving past the ball and therefore erodible balls may be preferred to dissolvable balls.

Furthermore, an erodible ball provides the advantage that the material can for example be rather slowly erodible such that the ball will not be substantially eroded on its way through the downhole string (even though it is in contact with the downhole fluid) and would thus not be substantially eroded and therefore be relatively useless before an opening or closing operation has been started or is completed. The ball used according to the disclosure will then, in combination with the downhole fluid pressure on the ball, only be sufficiently small to be flushed through the seat member down the circulating sub, e.g. by being eroded or collapsing/imploding on itself when having been eroded to a certain extent, after it has served its purpose.

BRIEF DESCRIPTION OF THE DRAWINGS

Embodiments of the present disclosure will now be described, by way of example, with reference to the accompanying drawings, in which.

DETAILED DESCRIPTION

The exemplary embodiments of the present invention are described and illustrated below to encompass apparatus and method relating to a circulating sub and also to a drop ball, and more particularly to a multi-activation circulating sub for use in energy exploration and drilling that can be opened and closed with dropped objects and more particularly can be repeatedly operated without having to use objects that increase in size. Of course, it will be apparent to those of ordinary skill in the art that the embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present invention.

Figure 1:
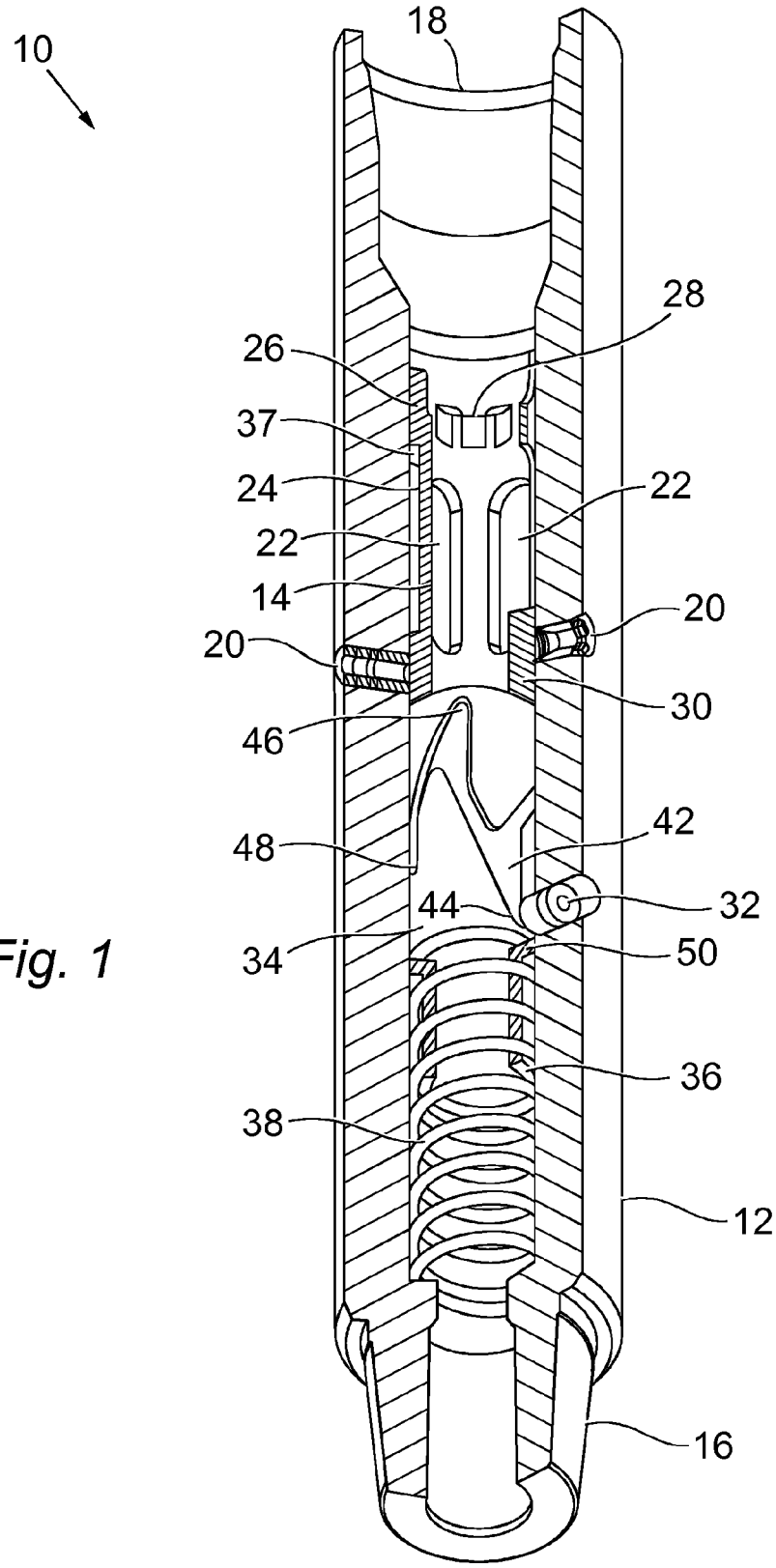
FIG. 1 is a part cross-sectioned perspective side view of a circulating sub apparatus according to the first aspect of the present disclosure in a closed configuration.

FIG. 1 shows an example of a circulating sub apparatus 10, also referred to as circulating sub 10 below, according to the first aspect of the present disclosure with an outer body member 12 and an inner body member 14. The outer body member 12 comprises a pin connection 16 on a lower end of the outer body member 12 and a box connection 18 on an upper end of the outer body member 12. The pin connection 16 comprises a screw threaded OCTG connection that allows the circulating sub 10 to be coupled to another downhole tubular such as a drill pipe or the like with a corresponding box connection. The box connection 18 also comprises a screw threaded OCTG connection that also allows another piece of Bottom Hole Assembly (BHA) or drill pipe or the like with a corresponding pin connection to be coupled to the circulating sub 10. In this view, two ports 20 are provided as apertures or holes through the sidewall of the outer body member 12. Further ports or holes through the sidewall of the outer body member 12 may be positioned on a back side of the outer body member 12 and/or on the part of the outer body member 12 which is cut away in FIG. 1 to provide additional potential fluid pathways through the sidewall of the outer body member 12. The inner body member 14 has elongated holes or slots 22 formed in an upper portion 24 thereof. A seat member 26 for catching or arresting movement of a drop ball (not shown) is provided on the top of the upper portion 24, above the holes 22 of the inner body member 14. The seat member 26 comprises slots 28 such that some downhole fluid can bypass the seat member 26 through these slots 28 when a drop ball is landed on the seat member 26.

At about its longitudinal midpoint, the inner body member 14 has a shoulder 72 which forms an upper end of a blocking or obturating portion 30 of the inner body member 14 and is described in further detail below.

The circulating sub 10 also comprises a displacement mechanism which is primarily adapted to control movement of the inner body member 14 relative to the outer body member 12. The displacement mechanism comprises a locking member in the form of a key 32, a cam sleeve 34, a tubular spring retainer 36 and a biasing mechanism, which is in exemplary form in the form of a coil spring 38.

The cam sleeve 34 is in exemplary form arranged such that it can freely rotate with respect to the inner body member 14 but in an alternative embodiment, the cam sleeve 34 can be rotationally locked to a lower portion 40 (FIG. 2*a*) of the inner body member 14 by, for instance, a spline arrangement (not shown). Thereby, it covers a least the length of the lower portion 40 of the inner body member 14, which is thus not shown in FIG. 1. A locking member in the form of a key 32 which is fixedly mounted on the outer body member 12 is engaged in a channel or slot 42 on an outer surface of the cam sleeve 34 such that the inner body member 14 can be selectively axially (longitudinally) locked with respect to the outer body member 12 according to locking positions 44, 46, 48 provided on the slot 42. The cam sleeve 34 is shown in more detail in FIGS. 3 and 4.

The tubular spring retainer 36 is secured to the lower end of the inner body member 14 and traps the cam sleeve 34 in position around the lower portion 40. The coil spring 38 is positioned in a lower part of the outer body member 12 immediately above the pin connection 16. At least some coils of the coil spring 38 are positioned around the tubular spring retainer 36. The tubular spring retainer 36 comprises a flange at its uppermost end which provides a shoulder 50 to prevent the coil spring 38 from contacting with the cam sleeve 34.

The significant parts having been described above, the operation of the circulating sub 10 will now be explained.

In certain operations, the circulating sub 10 is required to be run into a borehole in a closed or obturated position such as that shown in FIG. 1. The ports or holes 20, 22 of the outer and the inner body member 12, 14 are not aligned, so downhole fluid that is pumped from the surface down the throughbore of the drilling string to the drill bit at the very bottom of the drill string is forced to flow through the throughbore (i.e. inner passage 52) of the circulating sub 10 and subsequently downwards to equipment located below the circulating sub 10 such as a motor for drilling (not shown). In the closed or obturated configuration of the circulating sub 10, the holes or ports 20 of the outer body member 12 are additionally sealed with respect to the holes 22 of the inner body member 14 by suitable seals such as 'O' ring seals 31, 33 which are provided in corresponding grooves 74, 76 (FIG. 5), one of which is located above and one being located below the holes 22 on the obturating portion 30. At this point, (i.e. in the closed configuration) the key 32 is positioned in a closed locking position 44 which is the locking position on a lower part of the cam sleeve 34. The circulating sub 10 is also shown in the obturated configuration in FIG. 2*a*.

Figures 2A, 2B, 2C:
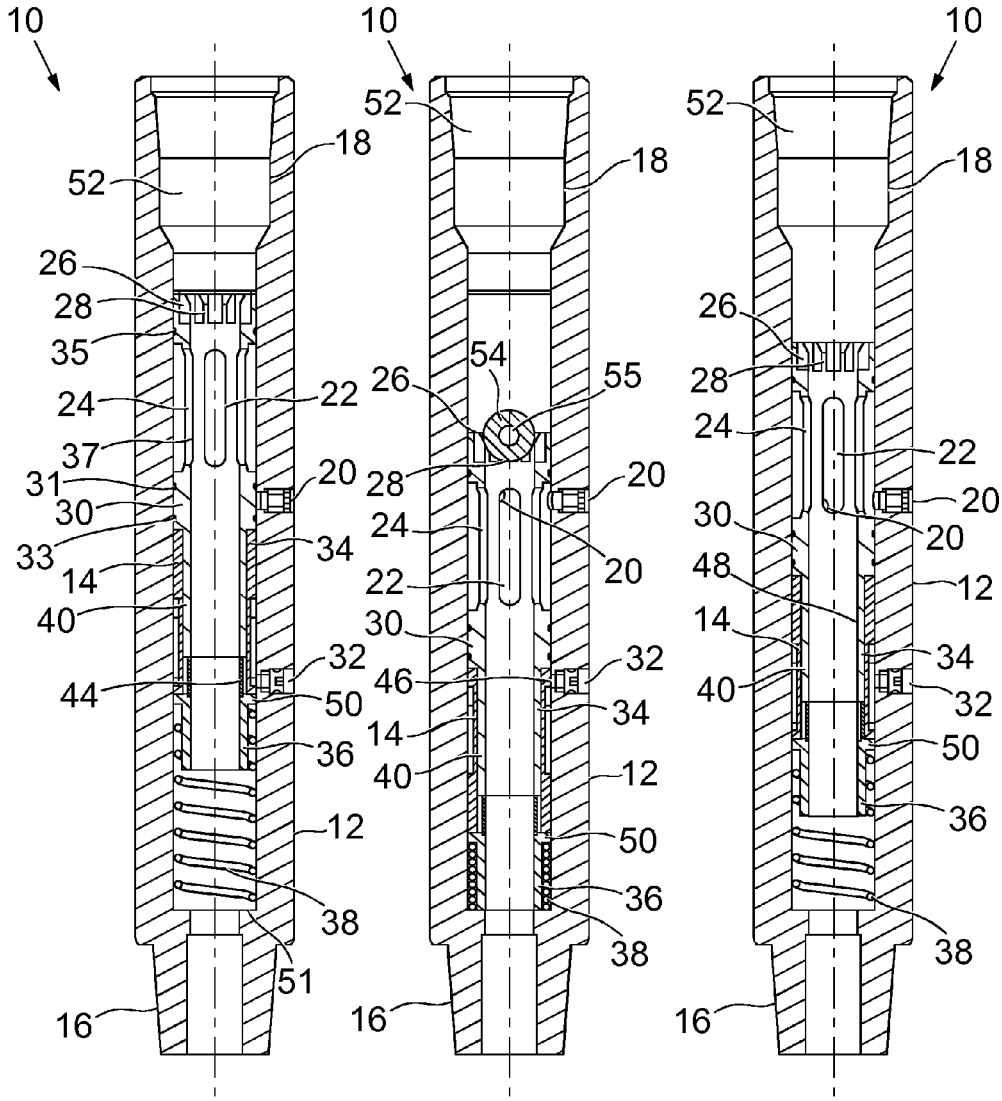
FIG. 2*a* is a cross-sectional side view of the FIG. 1 apparatus in the same closed configuration as that of FIG. 1.
FIG. 2*b* is a cross-sectional side view of the FIG. 1 apparatus in a first open configuration.
FIG. 2*c* is a cross-sectional side view of the FIG. 1 apparatus in a second open configuration.

If the operator wishes to open the ports 20, 22 (e.g. to pump LCM to plug the borehole when losses are experienced or to assist lifting drill cuttings back up to the surface from a particular location of the borehole), the operator drops a ball 54 into the fluid pumped down the throughbore at the surface. The ball 54 is of such a diameter that it is pumped down the throughbore of the drill string until it lands on the seat member 26 as shown in FIG. 2*b*. Downhole fluid flowing into the circulating sub 10 has therefore carried the ball 54 and landed it on the seat member 26 on the inner body member 14 because the diameter of the ball 54 is greater than the throat diameter of the seat 26. Although some downhole fluid may flow past the seat member 26 through the slots 28, the pressure in the downhole fluid located above the seat member 26 will increase high enough to overcome the biasing force of the coil spring 38 such that the inner body member 14 will move downwards. The cam sleeve 34 and the spring retainer 36 have also moved down consequentially. By means of vertically or longitudinally moving the cam sleeve 34, it is forced to rotate due to the fixedly mounted interaction of the key 32 in the slot 42. This way, the key 32 arrives at a first open locking position 46A (shown in FIGS. 3 and 4) on an upper end of the cam sleeve 34. The circulating sub 10 is now in an open configuration, in which the inner body member 14 is in its furthest position of travelling downwards with respect to the outer body member 12 within the circulating sub 10. The coil spring 38 is now in a compressed state and the lower end of the spring retainer 36 is in contact with a shoulder 51 at the lower end of the circulating sub 10 immediately above the pin connection 16. The elongated holes 22 of the inner body member 14 are positioned such that an upper part of them is aligned with the ports 20 of the outer body member 12. Indeed, downhole fluid is thus able to flow out of the circulating sub 10 through the ports 20 when the inner body member has moved a certain distance in the downward direction such that any part of the elongated holes 22 overlap the ports 20.

Figure 16:
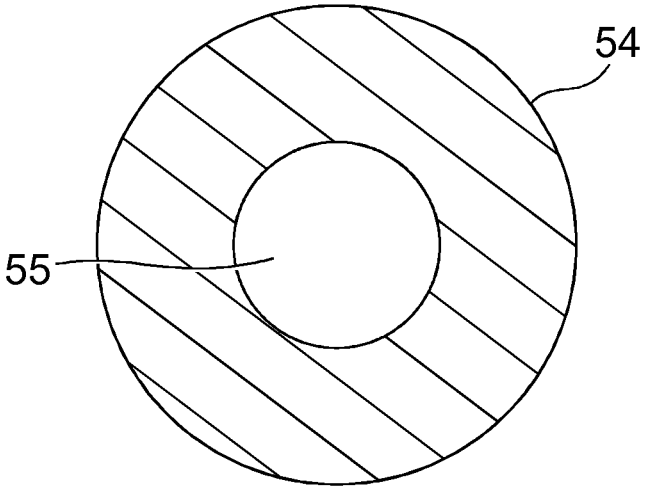
FIG. 16 is a cross-sectional side view of a drop ball in accordance with the second aspect of the present disclosure.

As shown in FIGS. 2*b* and 16, the hall 54 in accordance with the second aspect of the present disclosure and seated in the seat member 26 is hollow to a certain extent, for example 50 percent, of its diameter such that it contains a sealed chamber 55 at its centre. The chamber 55 may be filled with air or any other suitable gas or it could be void such that it contains a vacuum at its centre 55. Since the seat member 26 is positioned upstream of the elongated holes 22 of the inner body member 14, the downhole fluid which flows into the circulating sub 10 always has to flow past the ball 54 and through the slots 28 of the seat member 26 to flow out of the circulating sub 10 (whether through the ports 20 in the open configuration or through the bottom end 16).

The ball 54 is formed from a material which will erode due to the passing downhole fluid and examples of suitable erodible materials may be cement, or a mixture of sand and resin. Alternatively, the ball 54 could be formed from a soluble material such that the ball 54 dissolves rather than erodes, and an example of a suitable soluble material for such a dissolvable ball 54 is that used by Santrol (www.santrol.com) in their BIOBALLS MR®, but other erodible or soluble materials could also be used.

If an erodible material is used, the ball 54 will be eroded when it is exposed to downhole fluid for a certain period of time. When the erosion has proceeded to an extent at which the differential pressure between the internal atmospheric pressure of the ball 54 and the external downhole fluid pressure is sufficiently great, the ball 54 will collapse or implode on itself. Once the ball 54 has collapsed or imploded, the small debris is flushed through the seat member 26 down the circulating sub 10 with the downhole fluid. The pressure and thus the force exerted on the inner body member 14 is released as the inner passage 52 of the circulating sub 10 is no longer partially blocked by the ball 54. Due to the decreasing force on the inner body member 14, the biased coil spring 38 expands again, thereby moving the inner body member 14 and the cam sleeve 34 upwards. When moving upwards, the cam sleeve 34 is rotated due to the key 32 engaging the slot 42 (FIG. 1). The upward movement of the inner body member 14 is stopped in an intermediate position when the key 32 latches into an intermediate locking position 48 (see FIGS. 3 and 4 for details). This state of the circulating sub 10 is shown in FIG. 2*c*.

In the state shown in FIG. 2*c*, the circulating sub 10 is still in an open configuration and can be considered an intermediate open configuration in which a lower part of the elongated holes 22 of the inner body member 14 is aligned with the ports 20 of the outer body member 12, so the downhole fluid can still flow out through the ports 20. The coil spring 38 is still compressed to a certain extent. The circulating sub 10 will remain in the intermediate state shown in FIG. 2*c* (intermediate locking position 48 of FIG. 4) even when no downhole fluid is pumped through the circulating sub 10.

Figure 4:
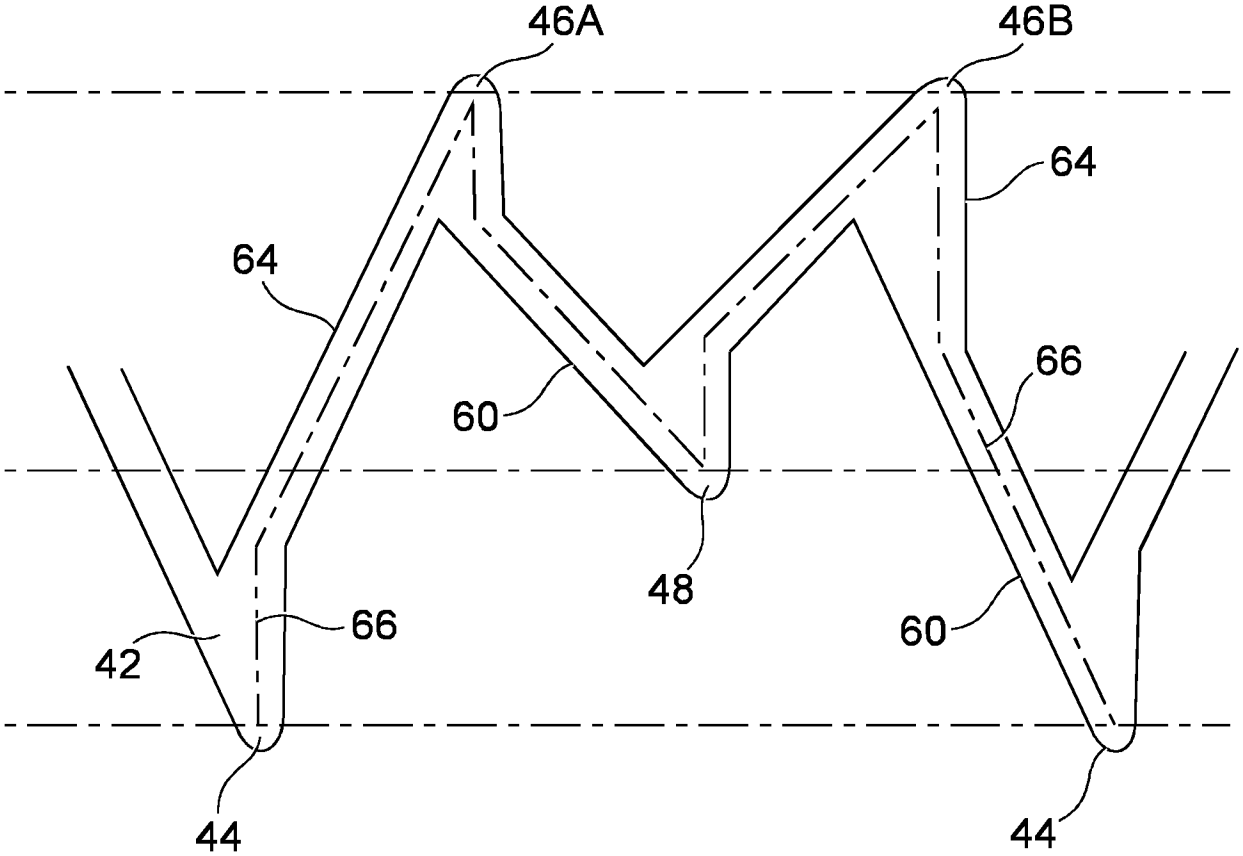
FIG. 4 is a diagram of the path steps of the cam sleeve of FIG. 3.

As shown in FIG. 4, the next state the circulating sub 10 may assume in this example is the second open configuration as shown in FIG. 2*b* in which the inner body member 14 is in its furthest position of travelling downwards the circulating sub 10 and where the key 32 arrests in the second open locking position 46B. This can be established when another (second) ball 54 in exemplary form in accordance with the second aspect of the present disclosure, which may be similar to the ball 54 shown in FIG. 2*b*, is dropped into the circulating sub 10 and lands on the seat member 26 and downhole fluid is pumped into the throughbore of the circulating sub 10.

The cam sleeve 34 can be provided such that the circulating sub 10 will return to a closed configuration. This operation will occur when the other (second) ball 54 leaves its place on the seat member 26, e.g. when it is eroded and collapsed/imploded on itself, so that the inner body 14 and consequently the cam sleeve 34 move upward again, and the key 32 finally latches into the closed locking position 44 (FIG. 1) again.

Figure 3:
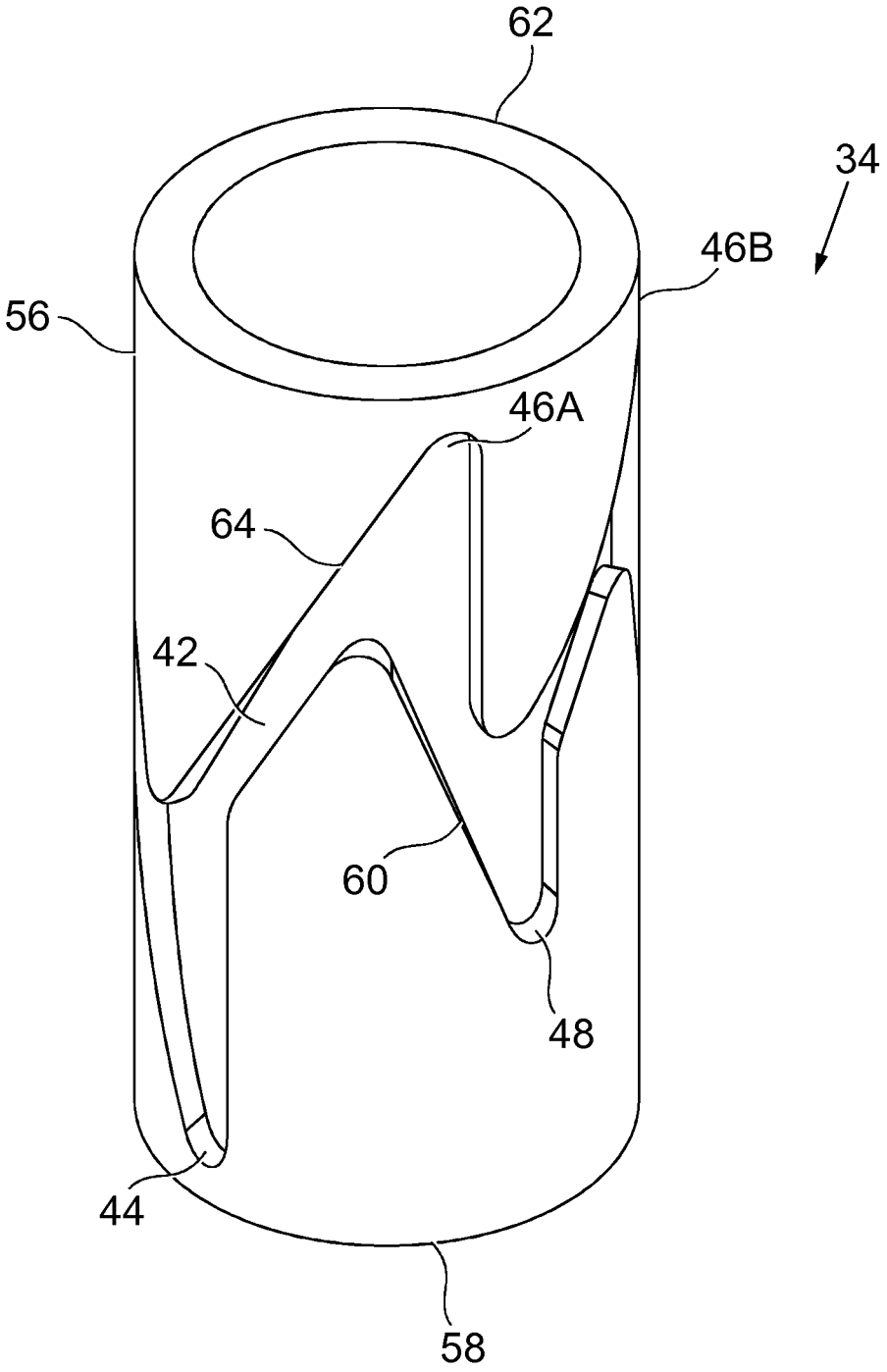
FIG. 3 is a perspective side view of a cylindrical cam sleeve incorporated in the circulating sub apparatus of FIG. 1.

FIG. 3 shows an example of a cam sleeve 34 to be utilized in the circulation sub 10 as shown in FIGS. 1, 2*a*, 2*b* and 2*c*. The cam sleeve 34 has a generally tubular body. On its outer cylindrical surface 56, the cam sleeve 34 is provided with a "W" shaped channel or slot 42 in which a locking member in the form of a key 32 (FIG. 1) can engage. The slot 42 is not as deep as the tubular body itself and is jagged in an unsymmetrical way around the outer side 56 of the cam sleeve. Four "V"-like shaped locking positions 44, 46A, 46B, 48 are shown, with two locking positions 44, 48 pointing with the vertex of the "V" towards a lower end 58 of the cam sleeve 34. These locking positions 44, 48 are modeled in a lower side 60 of the slot 42. One of these two locking positions is closer to the lower end of the cam sleeve 34 and is also referred to as the closed locking position 44, whereas the other is closer to a middle portion of the cam sleeve 34 and is also referred to as the intermediate open locking position 48. The two locking positions 46A, 46B pointing with the vertex of the "V" towards an upper end 62 of the cam sleeve 34 are also referred to as the first 46A and second 46B open positions. They are modeled in an upper side 64 of the slot 42. In cooperation with the key 32, the cam sleeve 34 is responsible for stopping the inner body member 14 (FIG. 1) in different positions, as shown for example in FIGS. 1, 2*a*, 2*b* and 2*c*. When the key 32 is positioned in the closed locking position 44, the inner body member 14 is in a position in which it obturates the ports 20 (FIG. 1) of the outer body member 12 as shown in FIG. 1 and FIG. 2*a*.

FIG. 4 is a diagram of the path steps of the cam sleeve of FIG. 3 and operation of the displacement mechanism will now be described in more detail. In the diagram, the slot 42 of the cam sleeve 34 is shown in a planar view. A path 66 is shown to illustrate the path of the key 32 (FIG. 1) when the circulating sub 10 (FIG. 1) is activated through one cycle of the various configurations. On the left side of the diagram of FIG. 4, the status of the circulating sub 10 is indicated, i.e. closed or opened (in a first and a second configuration). Above the diagram, the status of a pump (for pumping downhole fluid into the downhole string) and whether there is a ball in the seat member is indicated. The path 66 of the locking member 32 starts at the closed locking position 44 at a closed status or closed configuration of the circulating sub 10. In this state, downhole fluid can be pumped into the circulating sub 10 or not without affecting movement of the inner body member 14 relative to the outer body member 12. There is no ball 54 (FIG. 2*b*) in the seat member 26 (FIG. 1).

When the ball 54 is dropped and the inner body member 14 (FIG. 1) is moved downwards, the cam sleeve 34 also moves straight vertically downwards (i.e. without rotation) until the key 32 (FIG. 1), which is fixed to the outer body member 12 (FIG. 1), engages an upper side 64 of the slot 42. Further downward moving of the inner body member 14 will then force the cam sleeve 34 to rotate clockwise (when viewed from above) (either with or around the lower portion 40 (FIGS. 2*a*, 2*b*, 2*c*) of the inner body member 14 depending on if the sleeve 34 is respectively splined to the lower portion 40 or not) and the key 32 is guided through the narrow part of the slot 42. The elongated holes 22 (FIG. 1) of the inner body member 14 and the ports 20 (FIG. 1) will then start to overlap such that the closed status of the circulating sub 10 changes to an open status. The inner body member 14 is moved further downwards until the key 32 latches into the first open locking position 46A. This state of the circulating sub 10 (FIG. 1), the inner body member 14 and the cam sleeve 34 is shown in FIG. 2*b*. An open status or configuration of the circulating sub 10 is provided in which downhole fluid can flow out through the ports 20.

The cam sleeve 34 will stay locked with a key 32 (FIG. 1) locked in the first open locking position 46A until it is moved upward again with the inner body member 14 (FIG. 1). This will happen when the pressure on the inner body member 14 is released, for example when the ball 54 (FIG. 2*b*) is no longer located in the seat member 26 due to its erosion and/or collapse/implosion. When this is the ease, the cam sleeve 34 will not start rotating clockwise until the key 32 engages a lower side 60 of the channel 42. Thereby, the cam sleeve 34 is rotated towards an intermediate locking position 48 so that the inner body member 14 is in a position which is shown in FIG. 2*c*. With the key 32 positioned in this intermediate locking position 48, the inner body member 14 is in a position which is also referred to as intermediate open position and an open configuration of the circulating sub 10 (FIG. 2*c*) is still provided.

Only with a further downward movement of the cam sleeve 34, i.e. when higher pressure is exerted on the inner body member, for example when another ball 54 (FIG. 2*b*) is landed on the seat member 26 (FIG. 1), the key 32 (FIG. 1) will leave the open intermediate locking position 48. Thus, when the cam sleeve 34 rotates with or around the lower portion 40 (FIG. 2*a*) of the inner body member (FIG. 1), the next locking position is a second open locking position 46B and therefore provides an open port configuration as shown in FIG. 2*b*.

Once the second ball 54 erodes or dissolves away, the cam sleeve 34 will again move upwards such that the key 32 leaves the second open locking position 46B and upon rotation of the cam sleeve 34, the key 32 will arrive again back where it started in the closed locking position 44 and thus provides a closed port configuration of the circulating sub 10 as shown in FIG. 1.

It is important that downhole fluid is pumped through the downhole string to exert pressure on the ball 54 and the inner body member 14 (FIG. 1) when the hall 54 is seated and the cam sleeve 34 is moved such that the key 32 is positioned into the second locking position 46.

Accordingly, with the cam sleeve 34, the circulating sub 10 can be repeatedly actuated from a closed configuration to an open configuration by dropping one ball 54 and then to a closed configuration again by dropping another ball 54 into the downhole string, and this provides the advantage that the cycle can be repeated as many times as desired by the operator, with no limit on the number of cycles.

Figure 5:
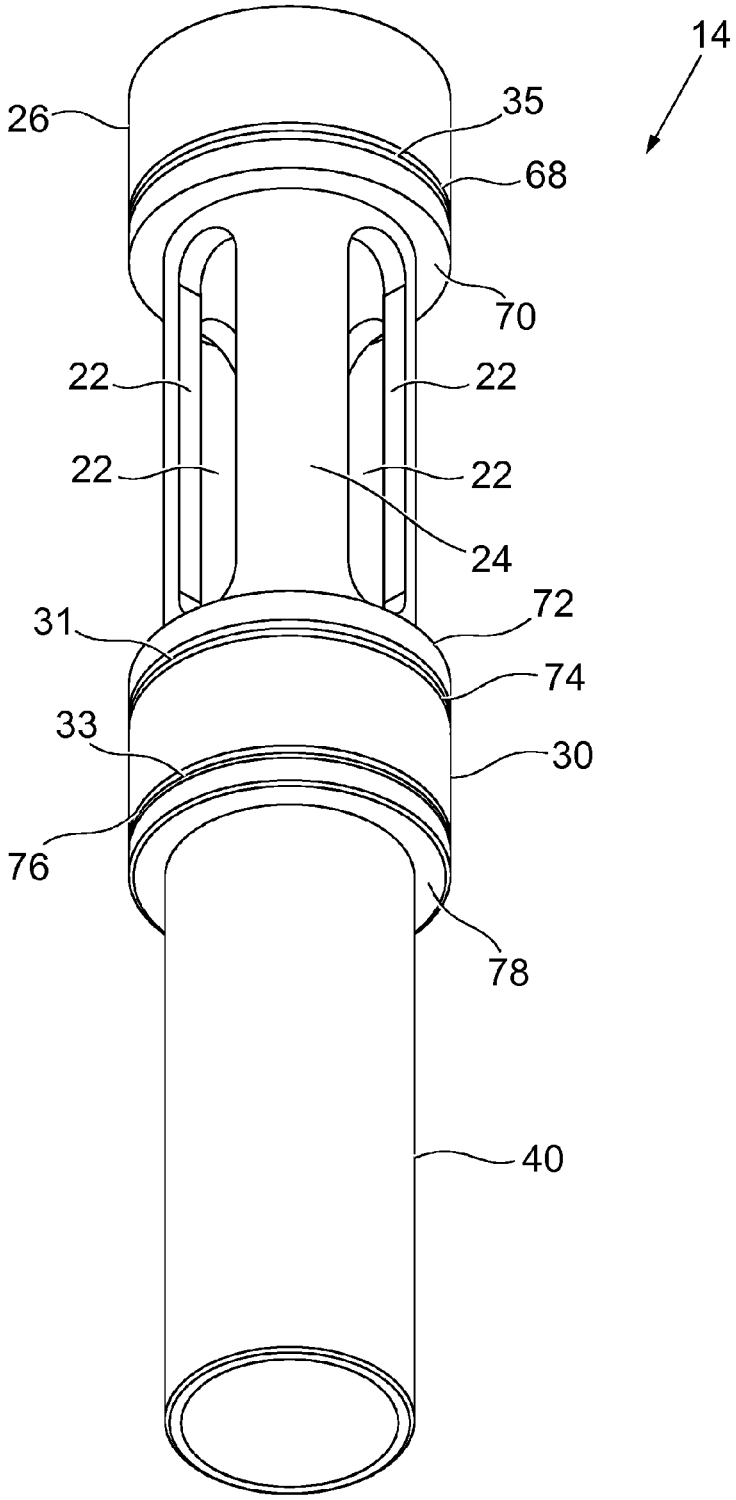
FIG. 5 is a perspective side view of an inner body member incorporated in the circulating sub apparatus of FIG. 1.

FIG. 5 shows an example of the inner body member 14, also referred to as piston, to be utilized in the circulation sub 10 as shown in FIG. 1. The inner body member 14 comprises an upper portion 24 and a lower portion 40. A seat member portion comprising the seat member 26 is located at the uppermost and upstream end of the upper portion 24. The seat member 26 is provided to catch a ball 54 (FIG. 2*b*) which is dropped down a downhole string (not shown) and the circulating sub 10 to at least partially block the inner passage or throughbore 52 (FIG. 1) of the circulating sub 10 thereby operating the circulating sub 10 to an open configuration as shown for example in FIGS. 2*b* and 2*c*, as will be discussed in detail subsequently. Not shown in the FIG. 5 view are slots 28 (seen in FIG. 1) of the seat member 26 which allow downhole fluid to partially flow past the seat member 26 through the inner body member 14 even when a ball 54 has landed on the seat member 26. The seat member portion comprises a circumferential or transverse groove 68 around an outer surface of the inner body member 14 in which a seal such as an 'O' ring seal 35 can be mounted to prevent downhole fluid from flowing past the outer side of the seat member 26. At a lower end of the seat member 26, there is a first shoulder 70 and below this shoulder 40, the outer diameter of the inner body member 14 is slightly less than the outer diameter at the seat member portion 26. In this reduced diameter part, the inner body member 14 comprises one or more holes or slots 22 which are evenly distributed around the circumference of the inner body member 14 and are elongated along a longitudinal axis of the inner body member 14. The elongated holes 22 are in exemplary form located such that they are aligned with holes or ports 20 (FIG. 1) of the outer body member 12 (FIG. 1) as shown in FIGS. 2*b* and 2*c* because this aligned arrangement reduces any frictional losses experienced by the fluid to a minimum, but the holes 22 and ports 20 need not be aligned because the fluid can pass around the annulus 37 between the outer surface of the upper portion 24 and the inner surface of the outer body member 12. When the inner body member 14 is moved relative to the outer body member 12, the elongated holes 22 allow an alignment with the holes or ports 20 of the outer body member 12 along a longitudinal distance up to the length of the elongated holes 22. Below the portion of the inner body member 14 comprising the elongated holes 22, the outer diameter of the inner body member 14 increases again at a second shoulder 72. This increased outer diameter is only retained for a certain distance along the longitudinal axis of the inner body member 14, thereby forming a portion of the inner body member 14 which can be referred to as a lower part of the upper portion 24 of the inner body member 14 or as a middle or blocking or obturating portion 30. This is because it is provided such that it obturates the ports 20 or holes of the outer body member 12 from inside the outer body member 12 when the circulating sub 10 is in a closed configuration as shown in FIG. 1 or FIG. 2*a*. Two transverse grooves 74, 76 are provided on the obturating portion 30 for mounting seals such as 'O' rings 31, 33. When the 'O' ring seals 31, 33 are provided, downhole fluid is prevented from flowing past the outer side of the obturating portion 30 further downwards. This will inhibit damage or other negative effects of the operating mode of the cam sleeve 34 for instance. After a third shoulder 78, the outer diameter of the inner body member 14 reduces again and the inner body member 14 comprises a lower portion 40 which is designated for being at least partially guided into the cam sleeve 34 as shown in FIG. 3. The cam sleeve 34 can in exemplary form freely rotate around (or is less in exemplary form rotationally locked to) the lower portion 40 of the inner body member 14 hereinbefore as described relating to FIG. 3.

Figure 6:
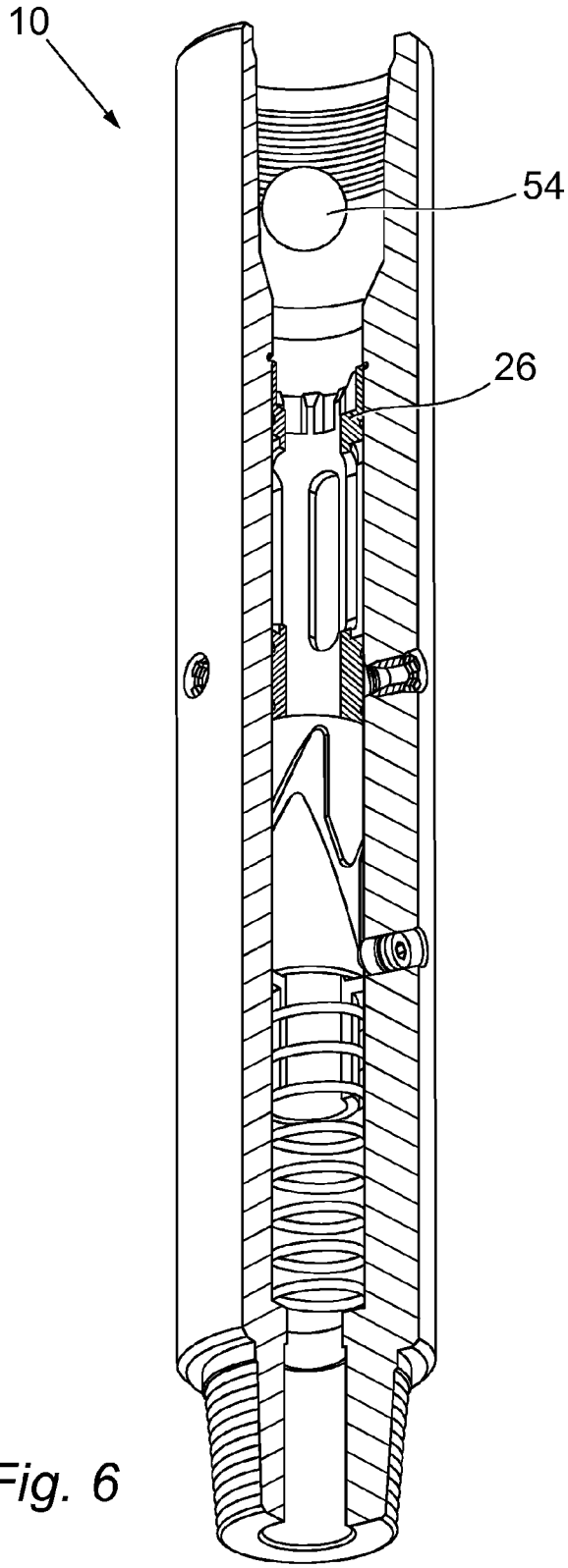
FIG. 6 is another part cross-sectioned view of the FIG. 1 apparatus in the same closed configuration as FIGS. 1 and 2*a* and just prior to a drop ball in accordance with the second aspect of the present disclosure landing on a seat of the circulating sub apparatus.

FIG. 6 shows the circulating sub 10 in a closed configuration, similar to the configuration shown in FIG. 1 and FIG. 2*a*. A ball 54 has already been dropped into the downhole string but has not yet landed on the seat member 26.

Figure 7:
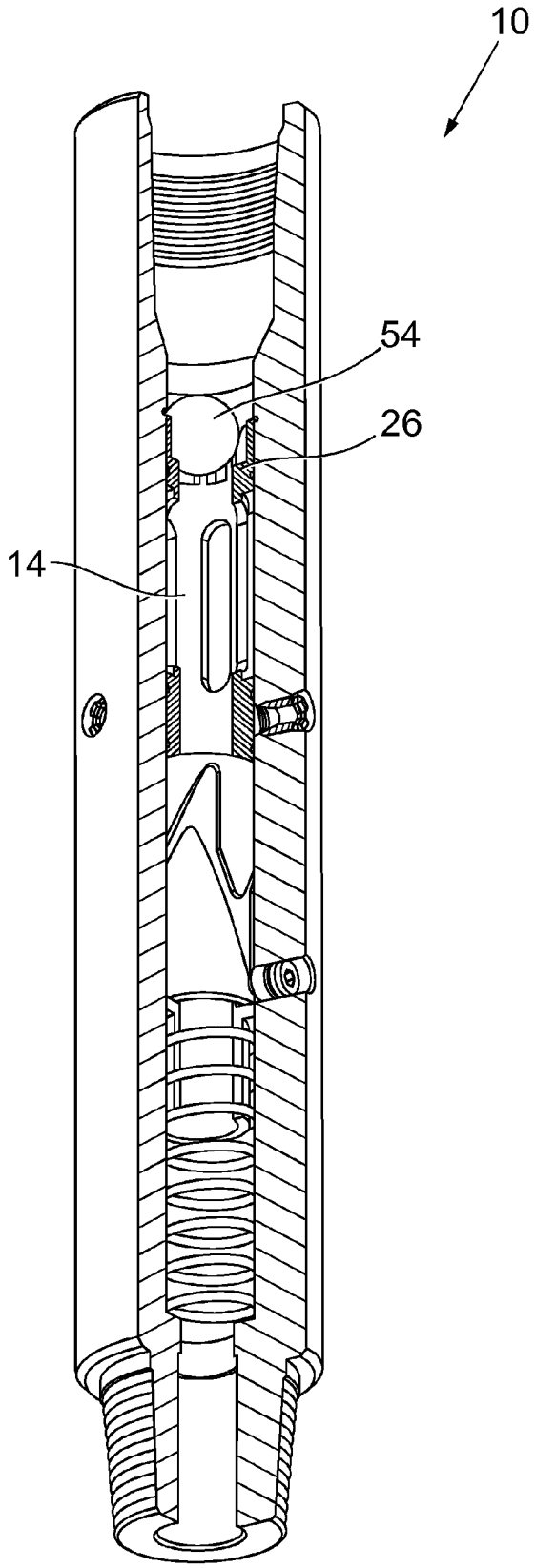
FIG. 7 is another part cross-sectioned perspective side view of the FIG. 1 apparatus in the same closed configuration as FIGS. 1, 2*a* and 6 but immediately as the drop ball of FIG. 6 has landed on the seat, but before the effect of the drop ball landing on the seat is experienced by the circulating sub.

FIG. 7 shows the circulating sub 10 also in the closed configuration as that at FIGS. 1 and 2*a* but when the ball 54 has landed on the seat member 26 but the inner body member 14 has not yet moved downwards, for example when downhole fluid has not yet started to build up enough force to result in movement of the inner body member 14.

Figure 8:
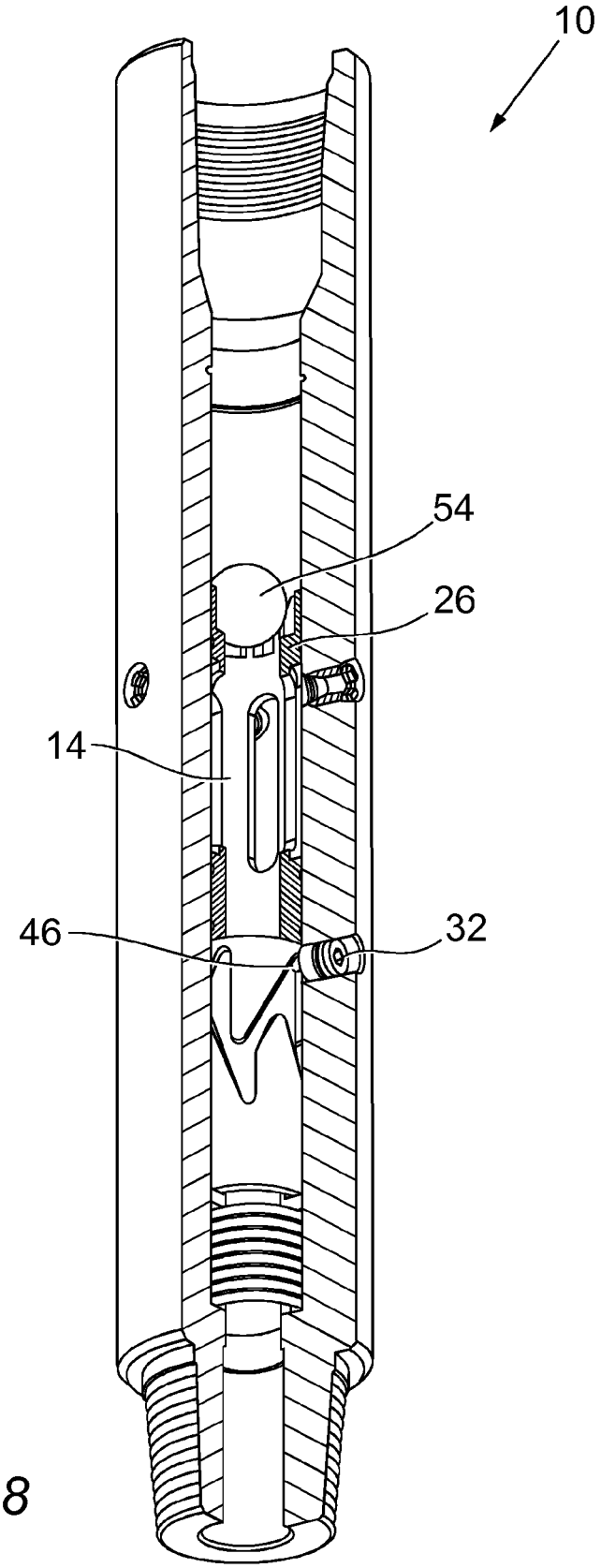
FIG. 8 is another part cross-sectional perspective side view of the FIG. 1 apparatus in the same first open configuration as that of FIG. 2*b* and with the drop ball of FIG. 6 still in position on the seat.

FIG. 8 is the circulating sub 10 in an open configuration, with the ball 54 still in the seat member 26, the inner body member 14 located in its furthest position down in the circulating sub, and the locking member 32 in the first open locking position 46A. This open port configuration is also shown in FIG. 2*b*.

Figure 9:
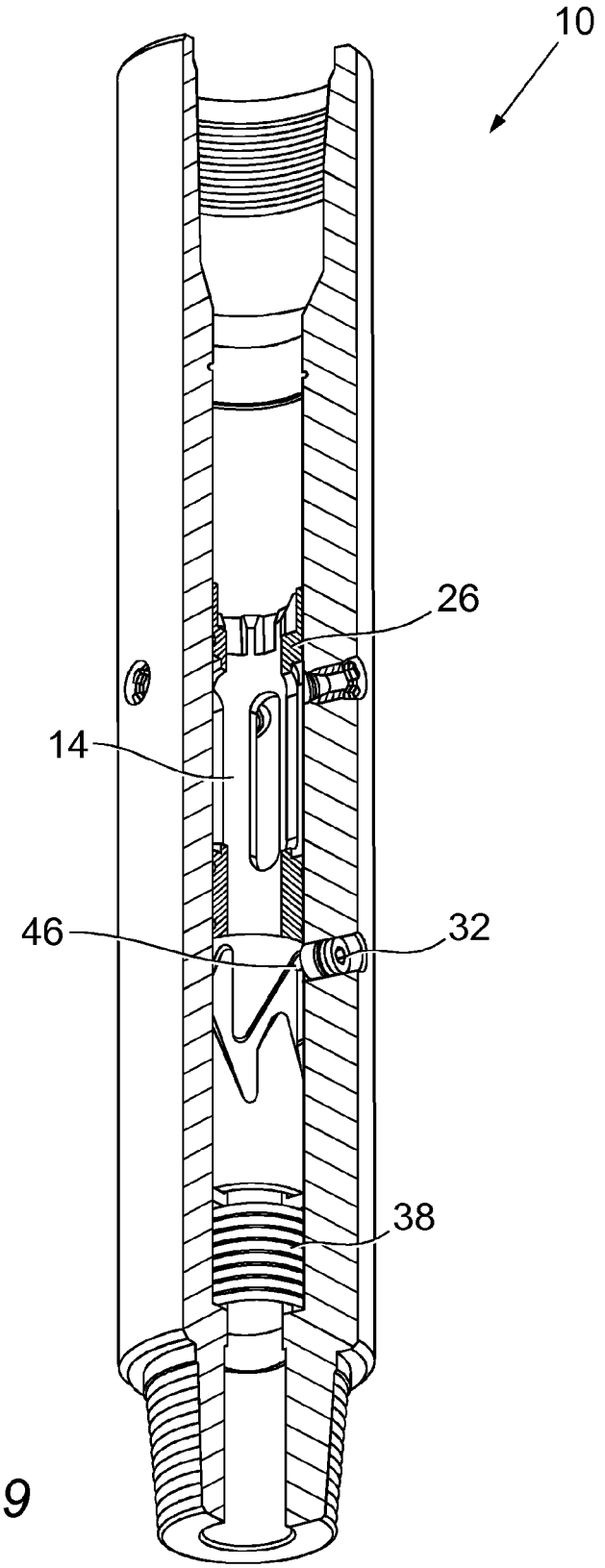
FIG. 9 is another part cross-sectional perspective side view of the FIG. 1 apparatus in the same first open configuration as that of FIG. 2*b* immediately prior to the ball having been eroded, but before that erosion is experienced by the circulating sub.
Figure 10:
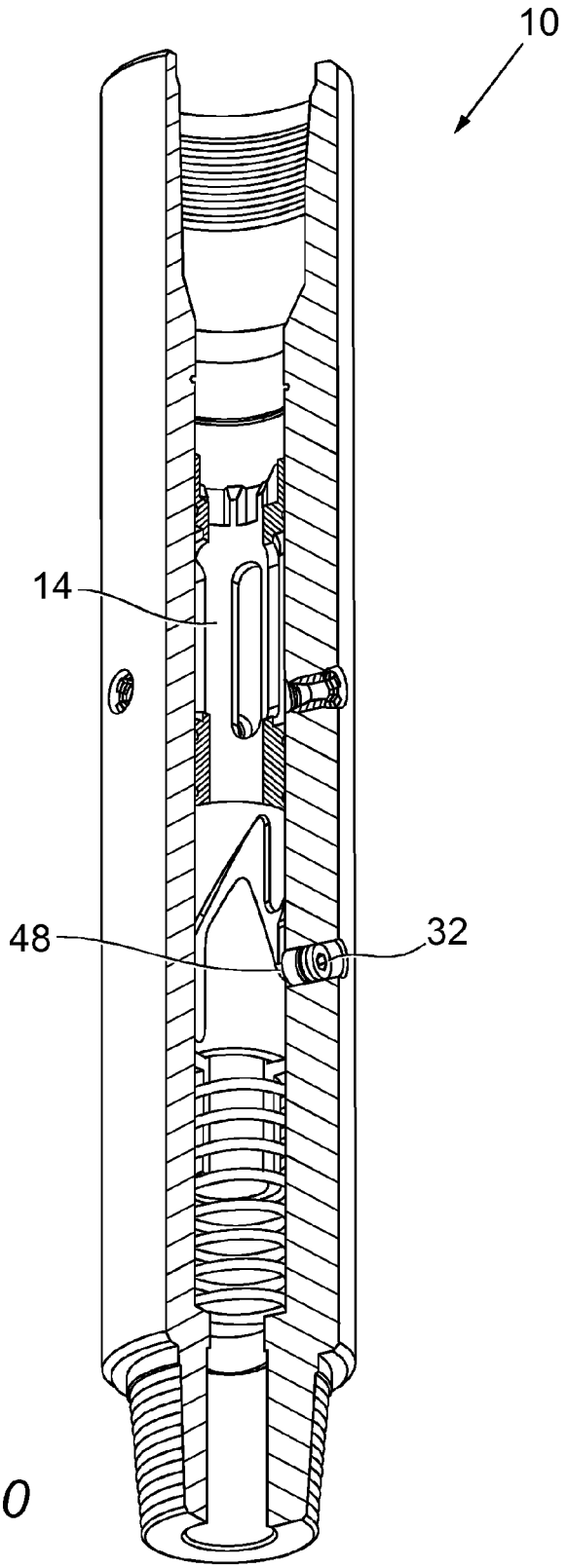
FIG. 10 is another part cross-sectional perspective side view of the FIG. 1 apparatus in the same second open configuration as that of FIG. 2*c;*

FIG. 9 shows the circulating sub 10 in the open port configuration of FIG. 8. The ball 54 has just dissolved, for example eroded to a certain extent and then collapsed and flushed down the circulating sub 10. At the moment in which the bail 54 has left the seat member 26, the pressure/force of the downhole fluid acting upon the inner body member 14 will immediately be reduced and the coil spring 38 will now force the inner body member 14 to move upwards again. This is shown in FIG. 10, where the inner body member 14 has moved upwards to an intermediate position, which still provides an open port configuration of the circulating sub 10. The inner body member 14 cannot move further upwards with the key 32 in the intermediate locking position 48, which is described in more detail with relation to FIGS. 3 and 4.

Furthermore, the circulating sub 10 will remain in the (intermediate) open position 48 no matter what the flow rate of the downhole fluid is (i.e. zero, full or any rate therebetween).

When the operator wishes to close the ports 22 to redirect all the downhole fluid down through the pin end 16 and onto other equipment below the circulating sub 10, the inner body member 14 has to move downwards again to be released from this position 48. Therefore, another ball 54 is dropped into the downhole fluid being pumped down the downhole string by the operator at the surface, as shown in FIG. 11.

Figure 11:
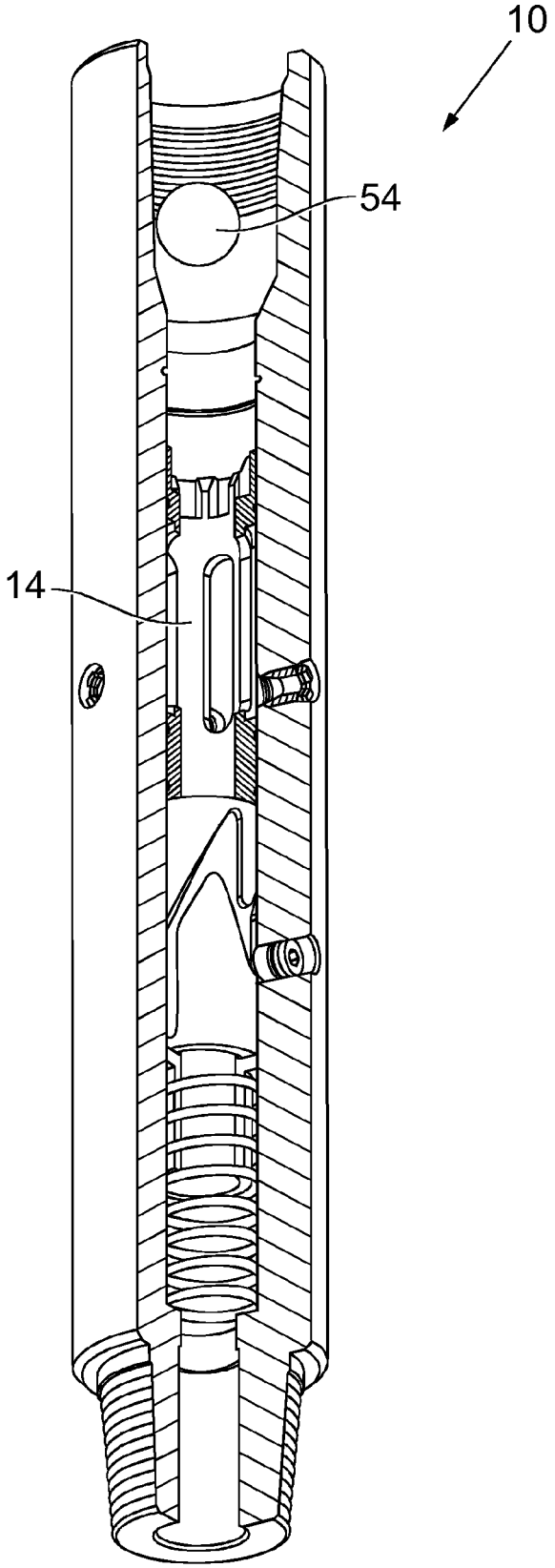
FIG. 11 is another part cross-sectional perspective side view of the FIG. 1 apparatus in the same second open configuration as that of FIG. 2*c* and just prior to another drop ball in accordance with the second aspect of the present disclosure landing on the seat.
Figure 12:
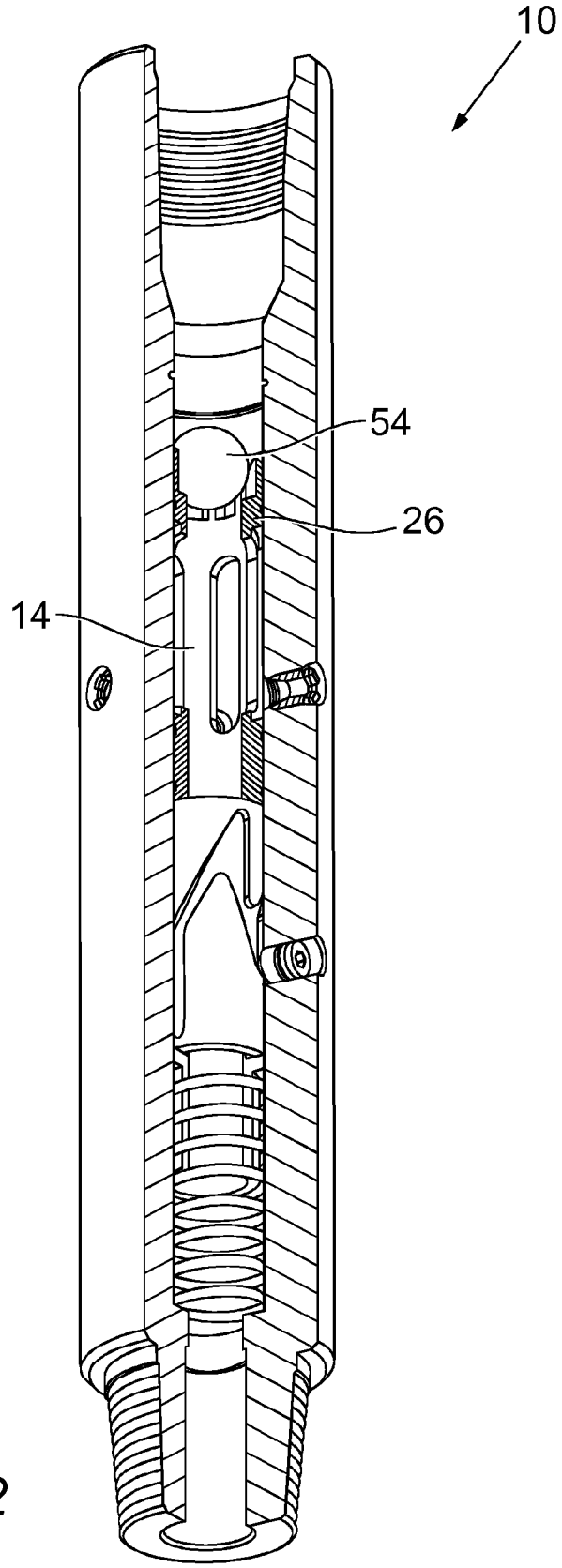
FIG. 12 is another part cross-sectional perspective side view of the FIG. 1 apparatus in the same second open configuration as that of FIG. 2*c* and immediately after the other drop ball of FIG. 11 has landed on the seat but before the effect of the drop ball landing on the seat is experienced by the circulating sub.

FIG. 12 shows the configuration of the circulating sub of FIGS. 10 and 11 but with the ball 54 landed on the seat member 26. The inner body member 14 has not yet moved downwards, but will do so due to the force created by the downhole fluid acting on the ball 54 and the inner body member 14.

Figure 13:
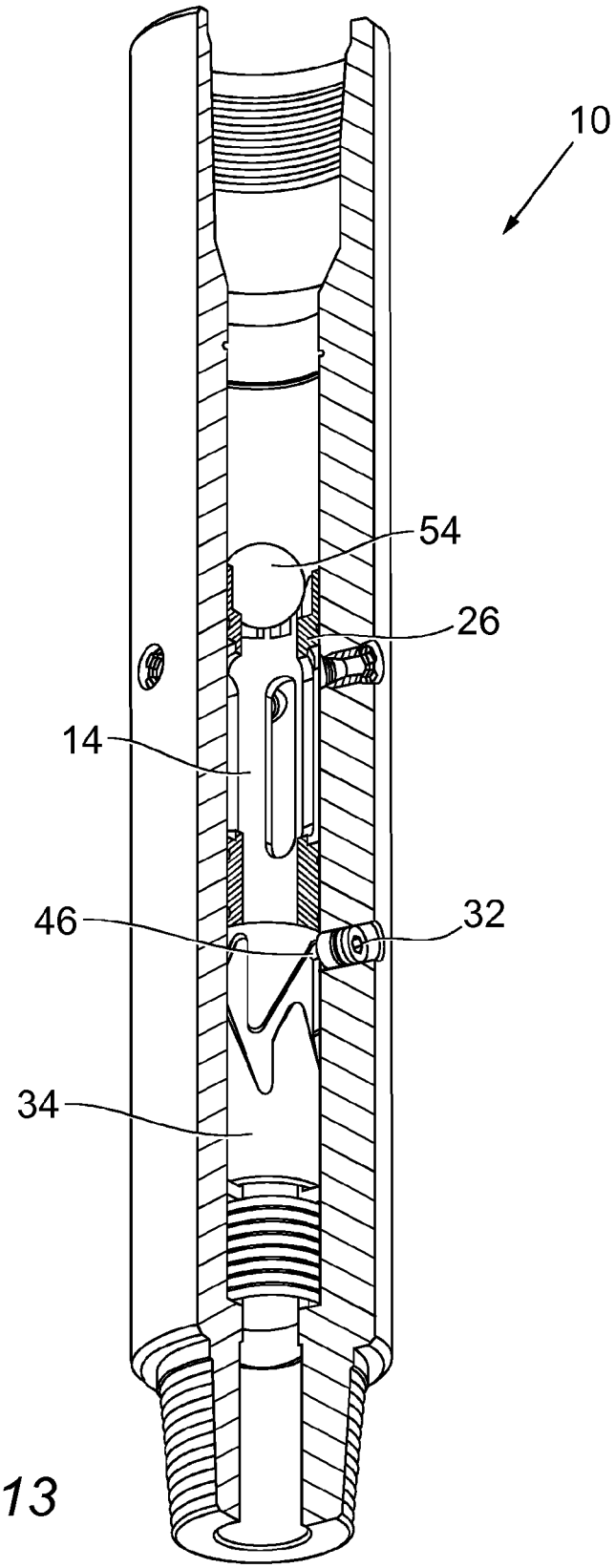
FIG. 13 is another part cross-sectional perspective side view of the FIG. 1 apparatus in the same first open configuration as that of FIG. 2*b* but with the second drop ball on the seat.

In FIG. 13, the inner body member 14 has moved downwards from the intermediate position of FIGS. 11 and 12 to its furthest position downstream in the circulating sub 10. The key 32 is, after further rotation of the cam sleeve 34, locked in a second open locking position 46B. The ball 54 is still in the seat member 26. The circulating sub 10 is in an open configuration similar to the configuration of FIG. 2*b* or FIG. 8, but the downhole fluid flowing past the ball 54 (the majority of which will then flow out through the open ports 20) will start to erode the ball 54.

Figure 14:
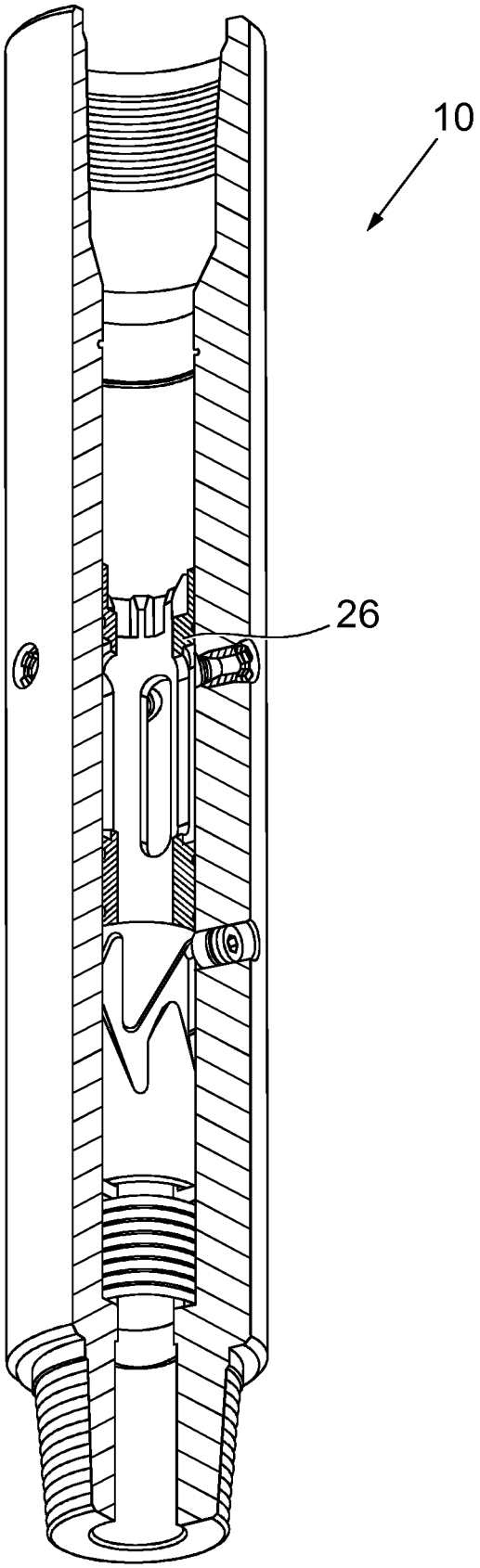
FIG. 14 is another part cross-sectional perspective side view of the FIG. 1 apparatus in the same first open configuration as that of FIG. 2*b* but immediately after the second drop ball has eroded away, but before the effect of that erosion is experienced by the circulating sub.

In FIG. 14, the ball has completely eroded/dissolved from the seat member 26. This state of the circulating sub 10 can be compared with the one described with relation to FIG. 9.

Figure 15:
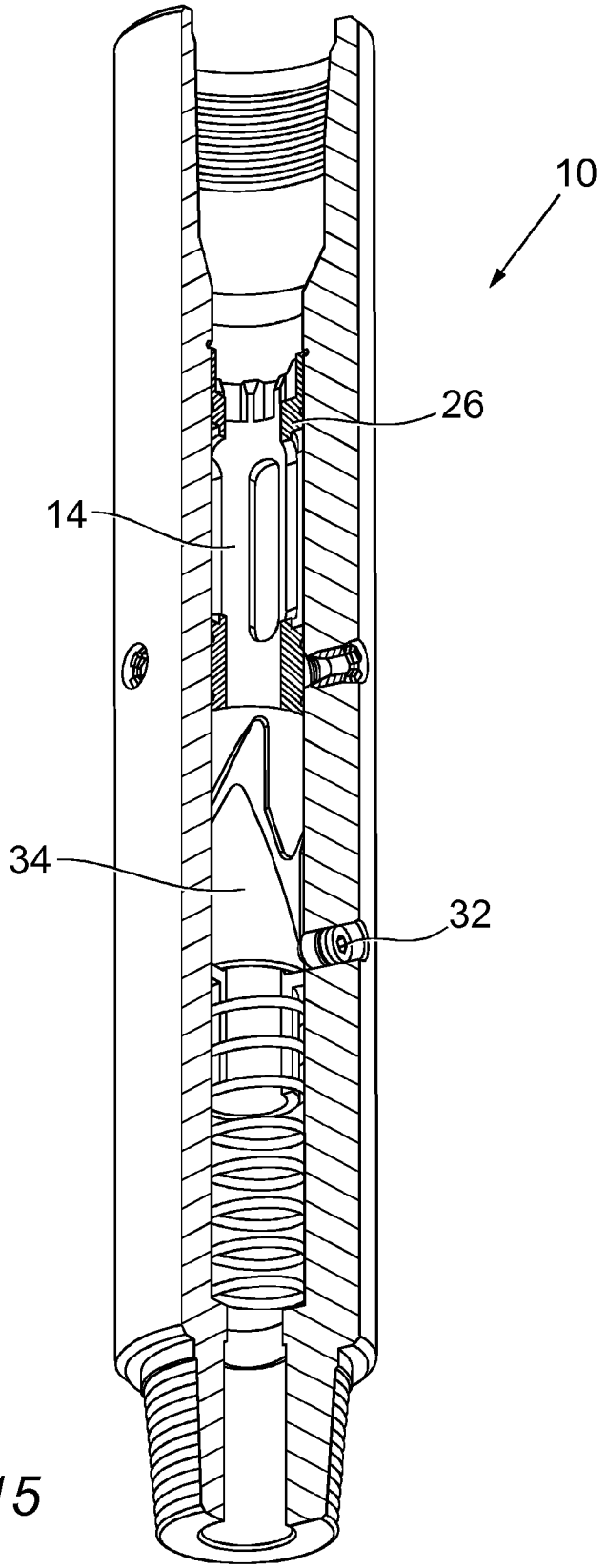
FIG. 15 is another part cross-sectional perspective side view of the FIG. 1 apparatus in the same closed configuration as that of FIG. 2*a*.

In FIG. 15, the inner body member 14 has moved upwards again due to the released force on the inner body member 14 when the ball has left the seat member 26. The next locking position on the cam sleeve 34, in which the key 32 latches upon rotation of the cam sleeve 34 due to upwards movement of the inner body member 14, provides a closed configuration of the circulating sub 10, which is similar to the configuration shown for example in FIGS. 1 and 2*a*. Thus, the cam sleeve 34 has completed one complete (360°) rotation and is now back to the position it started at and is ready for one or more further cycles of drop ball 54 operations if further circulation of downhole fluid through the ports 20 is desired or required.

FIG. 16 shows an example of a ball 54 according to the second aspect of the present disclosure which is hollow at its centre 55. The material of the ball 54 is erodible but it could also or alternatively be a soluble material and a suitable erodible material is cement and a suitable bonding material or sand and a suitable bonding material such as resin. At the centre 55 of the ball 54, there can be a vacuum or it can be filled with a suitable gas such as air at atmospheric pressure.

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A circulating sub apparatus comprising:

a substantially tubular outer body member having a throughbore formed therein;

a substantially tubular inner body member;

wherein at least the outer body member further comprises at least one hole formed therein; and a displacement mechanism for producing movement of the inner body member relative to the outer body member such that the inner body member is moveable between:

an open configuration, in which the hole(s) on the outer body member are open such that fluid is passable between the throughbore and the outside of the circulating sub apparatus via the one or more holes; and, an obturated configuration, in which the hole(s) on the outer body member are obturated;

wherein the inner body member comprises a seat member adapted to catch a dropped object, the seat member located upstream of the hole(s) of the outer body member in both the open and obturated configurations, and wherein the seat member is adapted to permit at least a proportion of fluid to flow past the dropped object when it is seated thereon.

2. A circulating sub apparatus as claimed in claim 1, wherein the inner body member is arranged to move, when, in use, the object is present on the seat member, especially by action of downhole fluid pressure and/or fluid flow.

3. A circulating sub apparatus as claimed in claim 1, wherein the inner body member comprises at least one hole therein and the hole(s) of the inner body and outer body are arranged such that movement of the inner body member into the open configuration moves the hole(s) of the inner body member into fluid communication with the hole(s) of the outer body member.

4. A circulating sub apparatus as claimed in claim 1, wherein the displacement mechanism is controllable in use by downhole fluid flow and/or pressure acting on at least a portion of the displacement mechanism.

5. A circulating sub apparatus as claimed in claim 1, wherein the displacement mechanism further comprises a locking mechanism for locking the inner body member in at least two positions relative to the outer body member.

6. A circulating sub apparatus as claimed in claim 5, wherein the locking mechanism further comprises a cam member comprising a lock device engageable with a slot arrangement comprising a series of slots.

7. A circulating sub apparatus as claimed in claim 6, wherein the cam member is circular and is shaped to move the lock device between the said slots all in the same rotational direction, such that the lock device is moveable from a first one of said slots to a second one of said slots, optionally via further slots, and then back to the first one of said slots; all in the same rotational direction.

8. A circulating sub apparatus as claimed in claim 6, wherein the inner body member comprises at least one hole therein and the cam member provides at least three locking positions, the first locking position in which the hole(s) of the inner and outer body member are in an obturated position, and two further locking positions the further positions each provide the open hole configuration of the hole(s) of the inner and outer body member.

9. A circulating sub apparatus as claimed in claim 1, wherein the displacement mechanism is adapted to permit the inner body member to be repeatedly moved between the open position and the obturated position.

10. A circulating sub apparatus as claimed in claim 1, wherein the displacement mechanism comprises a biasing mechanism for biasing the inner body member towards or into one of the open and obturated configurations.

11. A circulating sub apparatus as claimed in claim 10, wherein the biasing mechanism is arranged such that it urges the inner member in a direction opposite the direction which, in use, the inner member is urged by fluid flow onto the apparatus.

12. A method of using the circulation sub apparatus as claimed in claim 1, comprising dropping an object into the seat member, the object being adapted to erode or dissolve over time.

13. A circulating sub apparatus comprising:

a substantially tubular outer body member having a throughbore formed therein;

a substantially tubular inner body member;

wherein at least the outer body member further comprises at least one hole formed therein; and a displacement mechanism for producing movement of the inner body member relative to the outer body member such that the inner body member is moveable between:

an open configuration, in which the hole(s) on the outer body member are open such that fluid may pass between the throughbore and the outside of the circulating sub apparatus via the holes(s); and an obturated configuration, in which the hole(s) on the outer body member are obturated;

wherein the inner body member comprises a seat member adapted to catch a dropped object, and wherein the seat member is located upstream of the hole(s) of the outer body member.

* * * * *